US005462451A

United States Patent [19]

Yeh

[11] Patent Number: 5,462,451

[45] Date of Patent: Oct. 31, 1995

[54] ELECTRICAL CONNECTOR

[76] Inventor: Te-Hsin Yeh, 42, Sunneili, Fuhsin Li, Chungli City, Taoyuan, Taiwan

[21] Appl. No.: 259,688

[22] Filed: Jun. 13, 1994

[51] Int. Cl.[6] ..... H01R 9/07

[52] U.S. Cl. ..... 439/493; 439/567

[58] Field of Search ..... 439/452, 465, 439/449, 557, 567, 493

[56] References Cited

U.S. PATENT DOCUMENTS

| | | | |
|---|---|---|---|
| 4,139,727 | 2/1979 | Kuballa | 439/557 X |
| 4,886,942 | 12/1989 | Lenz et al. | 439/449 X |
| 5,308,258 | 5/1994 | Hatsios | 439/465 X |
| 5,334,048 | 8/1994 | Bowers et al. | 439/567 |
| 5,344,338 | 9/1994 | Colleran et al. | 439/465 |

*Primary Examiner*—Neil Abrams
*Assistant Examiner*—Barry Matthew L. Standig
*Attorney, Agent, or Firm*—Morton J. Rosenberg; David I. Klein

[57] ABSTRACT

An improved structure of an electrical connector is provided. The connector has two edge positioning legs, each leg having an appropriate outwardly directed incline extending toward the leg's distal end. The connector body is provided with a plurality of wire receiving openings disposed in parallel spaced relation, each opening having an insulation engaging tab disposed therein. Each of the tabs extends from an inner wall surface of a respective wire receiving opening at a downwardly directed incline. Each tab is provided with a pointed distal end for engaging the insulation surrounding the wire's conductor and resisting withdrawal of the wire from the connector body.

1 Claim, 4 Drawing Sheets

ELECTRICAL CONNECTOR

BACKGROUND OF THE INVENTION

The invention is directed to an improved electrical connector. More particularly, this invention is directed to a connector which can be installed on a main circuit board and is easy to assembly and use. The invention improves buckle strength, provides for a closer assemblage of parts and performs with better certainty. Further, the connector of this invention allows the wire material to be installed easily, smoothly, in close proximity to the circuit board, and secured tightly therein. Using the connector of this invention, the assembly of wire can be made conveniently, effortlessly, and rapidly.

PRIOR ART

The electronic connector structure and operations of prior art systems are shown in FIGS. 1 and 2. As shown, the two edges of main body 10 have extended positioning legs 101. There are braces 1011 formed on the outer surface of the lower edges of the positioning legs 101. There is a centrally disposed longitudinal slot 1012 of suitable length formed at the lower end of positioning legs 101 to increase spring force thereof and thereby permitting the easy insertion into respective position slots 201 on main board 20. There are several wire receiving slots 102 on main body surface 100. The wire receiving slots 102 are shorter than inner wall 1021. Slots 1022 of suitable length are formed on opposing sides of inner wall 1021 to increase spring force of a tab formed thereby. The tab includes a boss 1023 extending inwardly toward the wire receiving space and disposed on a central portion of inner wall 1021. The inner wall 1021 of position slot 102 will spring out while the lead wires 31 of wire material 30 are inserted into respective wire receiving slots 102. The boss 1023 presses against wire material 30 and holds it firmly. Obviously, the provision of slot 1012 on the two positioning legs 101, the slots 1022 on the inner wall of the wire receiving slots and the braces 1011 will improve the assembly process of main board 20 and lead wire.

The normal assembly process has some disadvantages because the strength of the positioning legs will be reduced by the longitudinal slots 1012. The whole assembly process might be uncertain and unstable. The characteristic of this structure is that it is weak. Naturally, the assembly process of brace 101 on main board 20 will have a weakness due to elastic fatigue. The structure may easily be pulled out, and there is uncertainty as to its securement. The inner wall 1021 of the wire receiving slot 102 has two open slots 1022 in order to form a tab to apply spring pressure on wire material 30. The tab is not only of ordinary shape but also subject to elastic fatigue. Especially, the boss 1023 which just lightly presses against the lead wire 31 of wire material 30. It is obvious that the wire material 30 can be pulled out easily. Thus, the assembly parts of this system produce an unstable assembly. The number of lead wires of wire material 30 may be different from that of the connector 10. Therefore, some number of lead wires must be removed from wire material 30. The remaining material 321 (see FIG. 1) of connecting web 32 should be removed. The wire material 30 could not be installed properly if the remaining material 321 of connecting web 32 were too big, or the structure of connector could be damaged.

SUMMARY OF THE INVENTION

The main object of the invention is to offer an improved structure of electrical connector. The two positioning legs each have a suitable internal surface extending outwardly. The extended inner surface of the positioning legs and the main board positioning slots will form an angle to hold each other firmly, to increase stability and certainty of main board installation.

Another object of this invention is to offer an improved electric connecting structure. A fork shaped brace is provided inside of the wire receiving slot. Wire material can be installed easily and with more convenience in light of the spring out force and fork shape of the brace. The wire material can therefore be installed more closely, tightly and stably.

One object of this invention is to provide a better electric connecting structure where the outside of the two edge positions each have a containing slot. When the wire material is installed, the remaining material on the sides thereof is received within the containing slot. This feature increases productivity, makes installation smoother, faster and better.

Another object of this invention is to offer the improved electric connecting structure where the buckle force strength is increased.

BRIEF DESCRIPTION OF THE DRAWINGS

For aiding in the understanding of an exemplary embodiment, detailed drawings are provided as follows.

DETAILED DESCRIPTION OF THE PREFERRED EMBODIMENT

Figure 1:
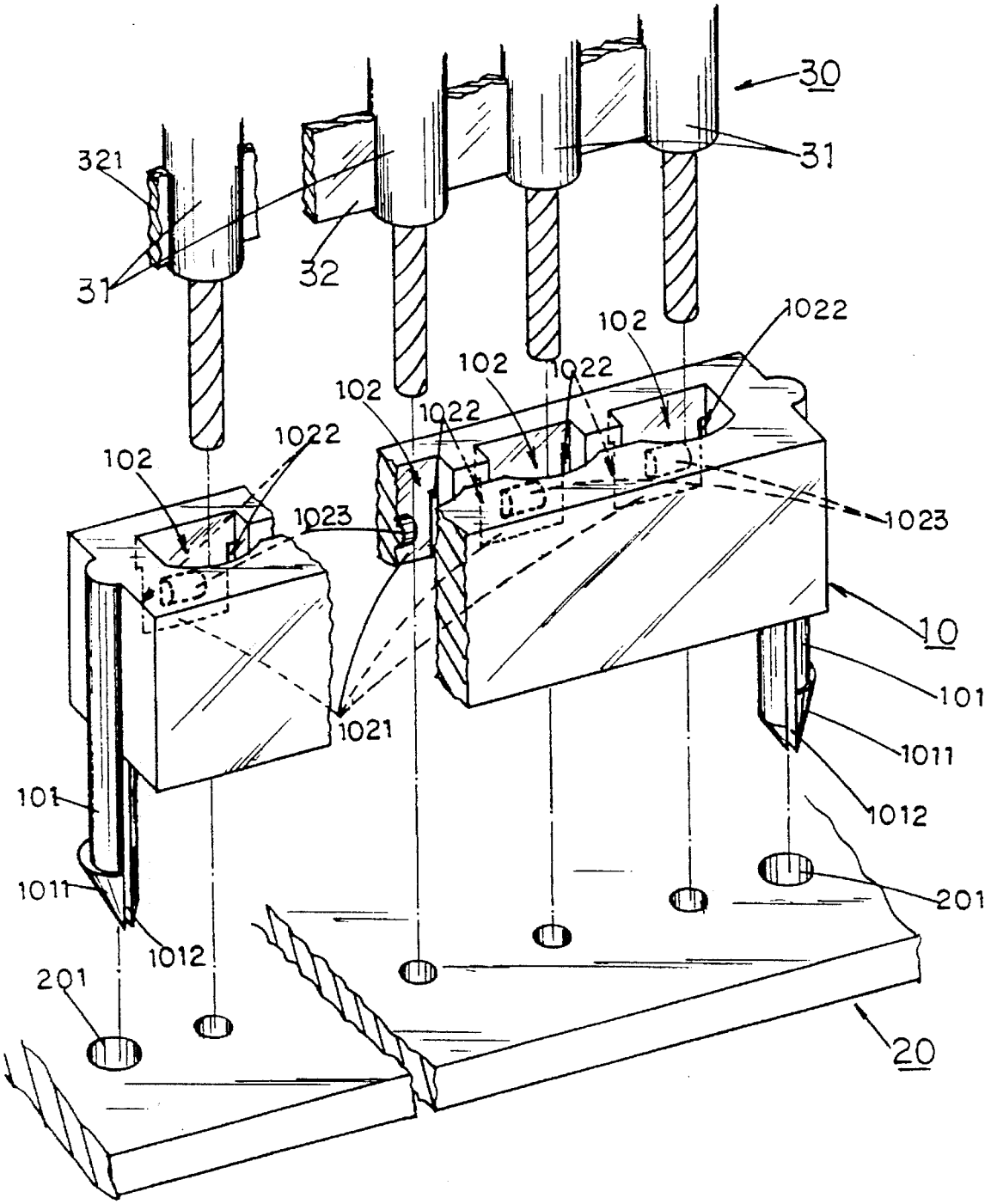
FIG.1 (PRIOR ART)
FIG. 1 is a perspective view of the relationship of a prior art electrical connector, the main circuit board and wire material.
Figure 2:
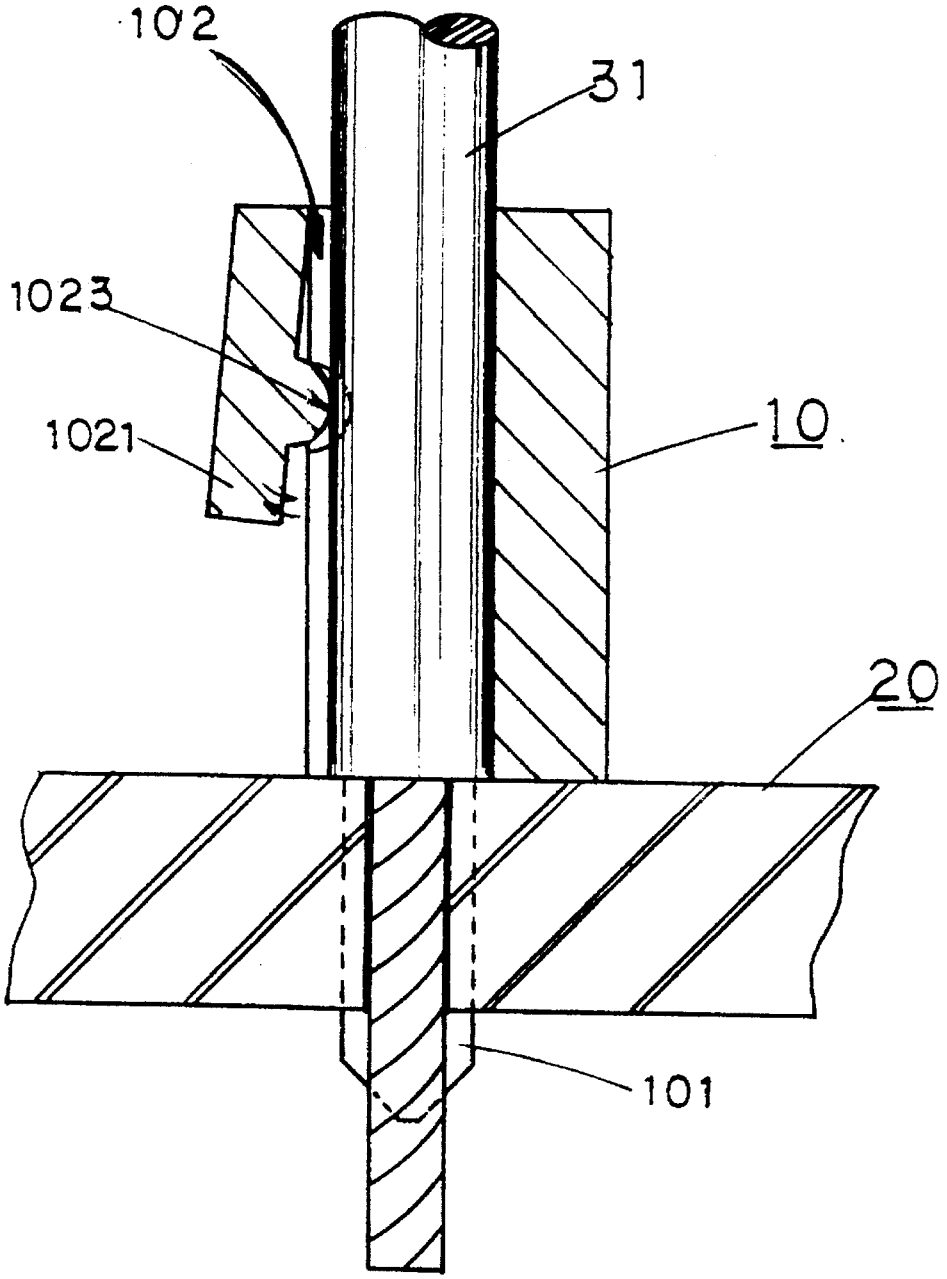
FIG.2 (PRIOR ART)
FIG. 2 is a cross-sectional side view of the prior art electrical connector of FIG. 1.
Figure 3:
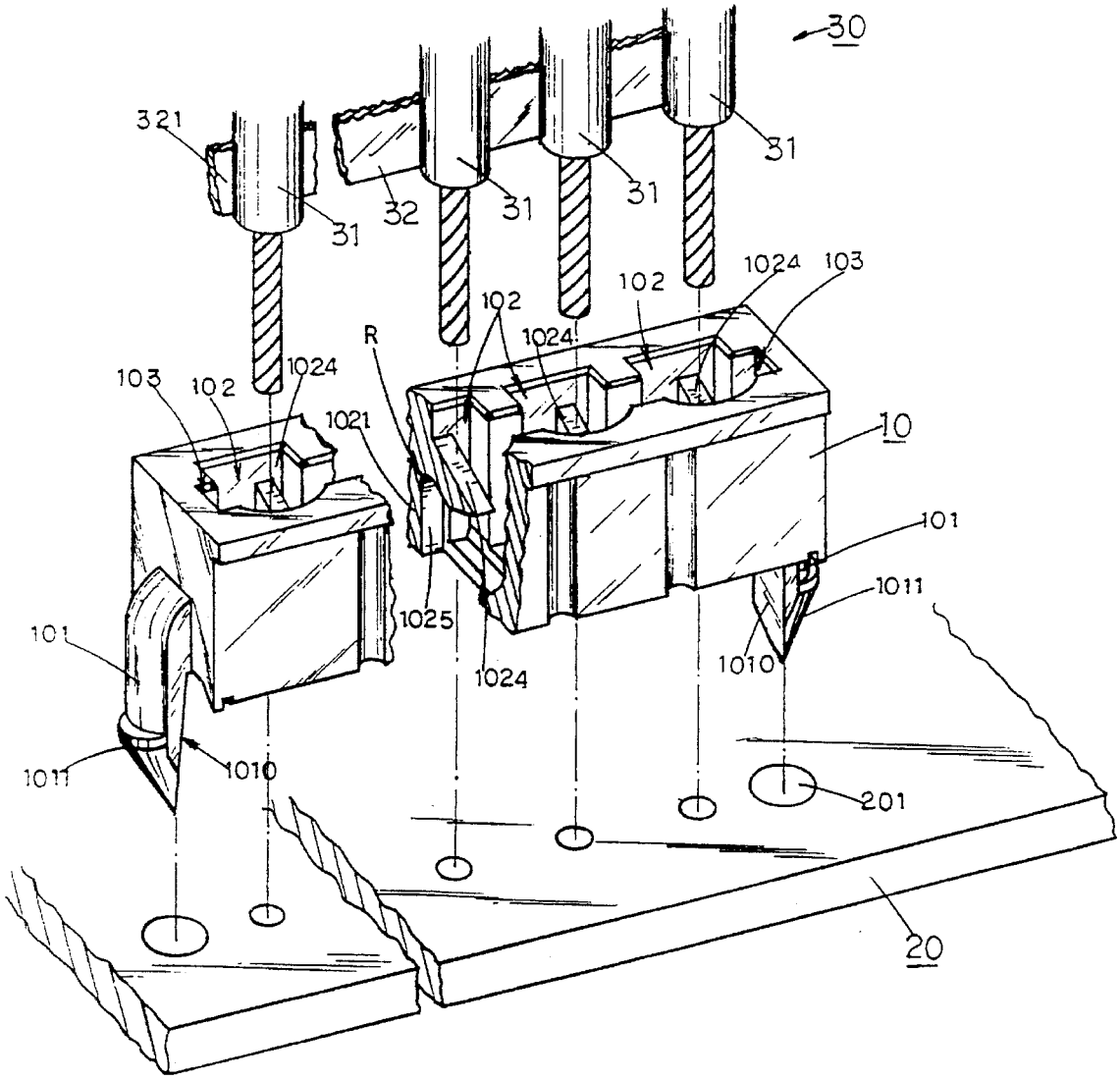
FIG. 3 is a perspective view of the improved electrical connector structure, main circuit board, and wire material.
Figure 4B:
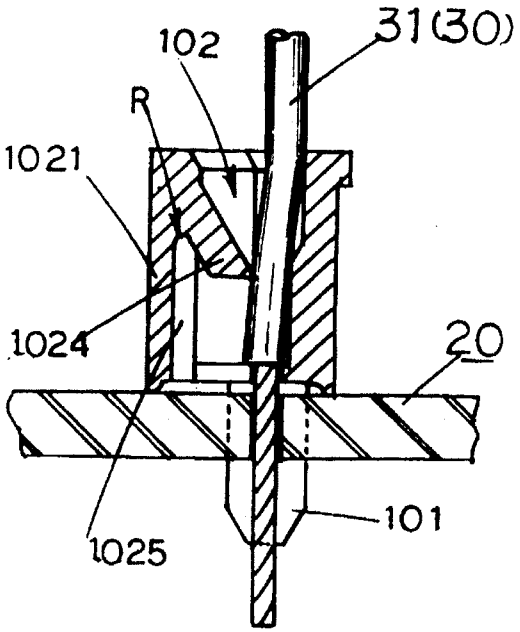
FIG. 4A is an elevation view of the improved electrical connector mounted to the main circuit board, shown in cross-section; and, FIG. 4B is a cross-sectional side view of the improved electrical connector.
Figure 4A:
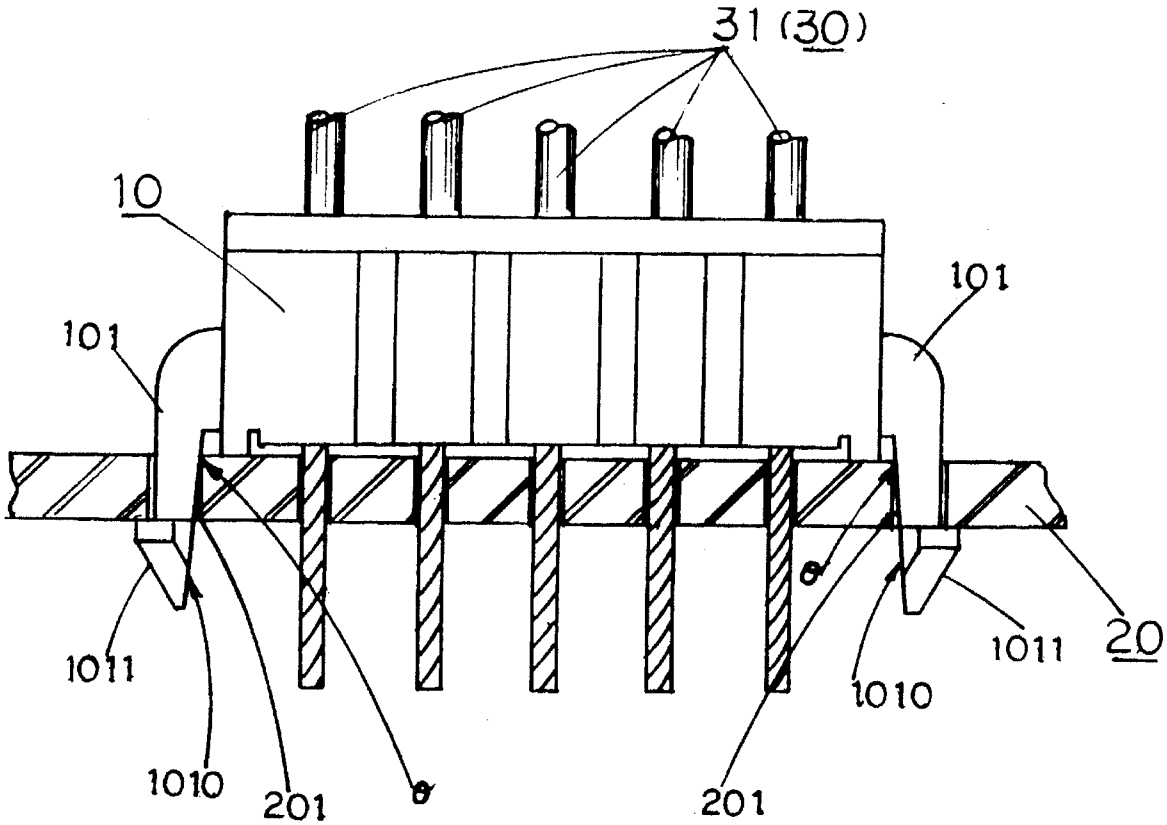

Shown in FIGS. 3, 4A and 4B, is the structure of an improved electrical connector. The structure of improved electrical connector has solid positioning legs 101 on the main body 10. The inner surface 1010 is formed so as to incline at an appropriate angle away from main body 10. A pointed tab 1024 of suitable length is formed on inner wall 1021 of the wire receiving slot 102. A suitable groove 1025 is formed in a section of inner wall 1021 and lower end of tab 1024 to permit displacement of tab 1024. The groove 1025 extends the length of tab 1024 in order to increase its spring force. An arch or radius R is formed at the upper end of groove 1025 to increase the spring force of tab 1024. At the same time, the radius R will help to increase resistance to buckling and failure due to fatigue. A structure having a sharp point is formed on the lower end of tab 1024. A containing slot 103 connecting with each end-most wire receiving slot 102 is provided.

The improved electrical connector structure improves the installation of main circuit board 20. The inner face 1010 of each of the two positioning legs 101 incline outwardly from the upper portion to the lower end thereof. Accordingly, the assembly process of joining the main body 10 to the main circuit board 20 through the positioning holes 201 will be smooth, convenient and rapid. An angle θ will be formed between the inner surface 1010 of positioning leg 101 and positioning opening 201 of main circuit board 20, because the inner face is inclined.

Since positioning leg 101 is made of solid material, without any longitudinal slot, the strength will be increased to secure the connector tightly and stably. The barb or brace 1011 can thereby be engaged with the lower end of a respective positioning opening 201. The positioning legs 101 and the whole connector will be very stable, and resist being pulled out.

Moreover, while the wire material 30 is being installed in the connector, each tab 1024 of the wire receiving slots 102 on main body 10 will start engaging a respective lead wire 31 by the insertion action. By virtue of the inclined orientation of tab 1024, wire installation is very smooth and convenient. At the same time tab 1024, having a suitable length and superb spring force, has a sharp fork shape directed downwardly on the lower end thereof, to hold lead wire 31 tightly. The remaining material 321 of the connecting web 32 of the wire material 30 is received within a containing slot 103, located at the outer edge of the endmost wire receiving slots 102. The remaining material 321 of the connecting web 32 will be introduced into a containing slot 103 while the material 30 is being installed into the wire receiving slot 102. Obviously, the remaining material 321 does not have to be cut off. This arrangement helps to increase production efficiency and will not result in damage to the connector.

The improved electrical connector is formed from a non-conductive plastic material. The installation process for lead wire 31 with respect to tab 1024, with its fork shaped lower end, requires no safety protection, since no conductive contact is made therebetween.

I claim:

1. An improved electrical connector for electrical cables, comprising:

a longitudinally extended connector body, said connector body having a plurality of longitudinally spaced wire receiving openings formed therethrough and a plurality of first slotted openings disposed between respective pairs of said plurality of wire receiving openings for receiving connecting insulation web portions of an electrical cable therein, said connector body having a pair of second slotted openings formed on respective longitudinal ends of opposing endmost wire receiving openings for receiving untrimmed portions of insulation webbing disposed on opposing longitudinal ends of the electrical cable, each of said wire receiving openings being an inner wall extending between opposing upper and lower ends of said wire receiving openings;

a plurality of tab members, each of said tab members extending angularly from an upper end of said inner wall of a respective wire receiving opening for engaging insulation portions surrounding a conductive wire of an electrical cable, each of said plurality of tab members having a sharp pointed lower end to resist withdrawal of the cable and a lower surface angularly extending to a radiused interface with said inner wall for increasing an engagement force of said tab member; and, a pair of transversely directed positioning legs, each of said pair of positioning legs being disposed on an opposing longitudinal end of said connector body, each of said pair of positioning legs having an inner surface facing said connector body and an opposing outer surface, said inner surface being outwardly inclined toward a distal end of said position leg, each of said positioning legs having a circuit board engaging barb formed on said outer surface adjacent said distal end, said barb having a planar upper surface extending substantially orthogonal said transverse direction for contiguous contact with a circuit board surface.

* * * * *